US006589019B2

(12) United States Patent
Terauchi

(10) Patent No.: US 6,589,019 B2
(45) Date of Patent: Jul. 8, 2003

(54) VARIABLE DISPLACEMENT COMPRESSOR

(75) Inventor: Kiyoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/059,214

(22) Filed: Jan. 31, 2002

(65) Prior Publication Data

US 2002/0114704 A1 Aug. 22, 2002

(30) Foreign Application Priority Data

Feb. 16, 2001 (JP) ..... 2001-040457

(51) Int. Cl.[7] ..... F04B 49/00

(52) U.S. Cl. ..... 417/63; 73/862.331; 73/862.321; 73/862.324

(58) Field of Search ..... 417/63, 53, 272.2, 417/44.1; 62/228.1, 228.5; 73/862.331, 5, 862.336, 862.321, 862.324

(56) References Cited

U.S. PATENT DOCUMENTS 4,697,460 A * 10/1987 Sugiyama et al. ..... 73/862.36
5,195,382 A * 3/1993 Peilloud ..... 73/862.321
5,708,216 A * 1/1998 Garshelis ..... 73/862.235
6,285,024 B1 * 9/2001 Pinnock ..... 250/231.13

FOREIGN PATENT DOCUMENTS

JP 5164045 6/1993

* cited by examiner

*Primary Examiner*—Charles G. Freay
*Assistant Examiner*—Han L Liu
(74) *Attorney, Agent, or Firm*—Baker Botts L.L.P.

(57) ABSTRACT

A compressor includes a front housing, a cylinder block, a cylinder head, a torque transmission mechanism, a reciprocating mechanism, and torque determination means. The torque transmission mechanism includes a pulley, a plate-shaped elastic member, a hub, a drive shaft, and a rotor. The torque determination means includes a first marker affixed to the pulley, a second marker affixed to the hub a first sensor affixed to the front housing which generates a first timing signal when the first marker is positioned within substantially the same vertical plane as the first sensor, and a second sensor affixed to the front housing which generates a second timing signal when the second marker is positioned within substantially the same vertical plane as the second sensor. Moreover, there is a time differential between the generation of the first and second timing signals corresponding to the angular offsets, and the torque of the compressor is determinable from the time differential.

21 Claims, 4 Drawing Sheets

VARIABLE DISPLACEMENT COMPRESSOR

BACKGROUND OF THE INVENTION

1. Field of the Invention

The present invention relates generally to the field of variable-displacement compressors for use in air conditioning apparatus. More particularly, the present invention is directed towards variable-displacement compressors employing means for determining the torque for determining a torque of the compressor.

2. Description of the Related Art

An externally controlled, variable-displacement compressor, e.g., a swash plate-type, variable-displacement compressor, may be employed in a refrigeration circuit of a vehicular air conditioning apparatus. In operation, a refrigerant may be introduced into a crank chamber via a discharge chamber, and the amount of refrigerant introduced into the crank chamber may be controlled by an external signal operating a control valve. Moreover, a magnitude of a displacement of the compressor may correspond to a refrigerant pressure within the crank chamber, and an inclination angle of a swash plate may vary in accordance with the refrigerant pressure. As such, the external signal may control the magnitude of the displacement of the compressor.

An objective magnitude of displacement of the compressor may depend on a magnitude of a load of the air conditioning apparatus, i.e., a magnitude of a torque load of the compressor. Nevertheless, the magnitude of the torque load may vary over time. Consequently, in order to control the displacement of the compressor, the magnitude of the torque of the compressor may be monitored during operation of the compressor.

A known method of determining the magnitude of the torque of the compressor includes indirectly calculating the magnitude of the torque based on magnitudes of various detectable parameters related to the refrigeration circuit. Such detectable parameters may include suction pressure, suction temperature, and discharge pressure of the compressor.

Japanese Patent Publication No. Hei 5-164045 describes a method for directly detecting the magnitude of the torque of the compressor by sensing a magnetostriction, e.g., the dependence of the state of strain of a ferromagnetic element on the direction and strength of its magnetization, of a magnetic membrane which is entwined around a drive shaft of the compressor and includes a slight twisting deformation. Nevertheless, because magnetic detectors are assembled into a cylindrical portion of front housing, inclusion of the magnetic detectors increases a cost associated with the manufacture of the compressor.

SUMMARY OF THE INVENTION

Therefore, a need has arisen for compressors, and methods of employing such compressors, which overcome these and other disadvantages of the related art. A technical advantage of the present invention is that a compressor includes means for detecting a time differential between a first timing signal generated by a first sensor and a second timing signal generated by a second sensor, such that a torque of the compressor may be determined based on the time differential.

In an embodiment of the present invention, a compressor, e.g., a variable-displacement compressor, is described. The compressor comprises a front housing, a cylinder block, a cylinder head, and a torque transmission mechanism. The torque transmission mechanism comprises a pulley, a plate-shaped elastic member connected to the pulley, a hub connected to the plate-shaped elastic member, a drive shaft connected to the hub, and a rotor connected to the drive shaft. The compressor also comprises a reciprocating mechanism connected to the torque transmission mechanism. The compressor further comprises means for determining, e.g., calculating, detecting, measuring, or the like, a torque of the compressor. The means for determining comprises a first marker affixed to the pulley and a second marker affixed to the hub. In a variation of this embodiment, the second marker is affixed to the drive shaft. Moreover, a circular deformation of the plate-shaped elastic member creates an angular offset between the first marker and the second marker. The means for determining also comprises a first sensor affixed to the front housing which generates a first timing signal when the first marker is positioned within substantially the same vertical plane as the first sensor. The means for determining further comprises a second sensor which generates a second timing signal when the second marker is positioned within substantially the same vertical plane as the second sensor. When second marker is affixed to the hub, the second sensor is affixed to the front housing. Nevertheless, in the variation of this embodiment, when the second marker is affixed to the drive shaft, the second sensor is positioned within a center bore of the cylinder block. Further, there is a time differential between when the first marker is positioned within substantially the same vertical plane as the first sensor and when the second marker is positioned within substantially the same vertical plane as the second sensor. Moreover, the time differential corresponds to the angular offset and the torque of the compressor is determinable from the time differential.

In another embodiment of the present invention, a method of determining a torque of a compressor is described. The method comprises the steps of affixing a first marker to a pulley and affixing a second marker to a hub. In a variation of this embodiment the method includes the step of affixing the second marker to a drive shaft. Moreover, a circular deformation of a plate-shaped elastic member, which is affixed to the hub and also is affixed to the pulley, creates an angular offset between the first marker and the second marker. The method also comprises the steps of affixing a first sensor to a front housing, and affixing a second sensor to the front housing when the second marker is affixed to the hub. In the variation of this embodiment, the method comprises the step of positioning the second sensor within a cylinder bore of a cylinder when the second marker is affixed to the drive shaft. The method further comprises the steps of generating a first timing signal when the first marker is positioned substantially within the same vertical plane as the first sensor, and generating a second timing signal when the second marker is positioned substantially within the same vertical plane as the second sensor. The method also comprises the step of determining, e.g., calculating, detecting, measuring, or the like, the torque of the compressor. The torque of the compressor is determined based on a time differential between when the first marker is positioned within substantially the same vertical plane as the first sensor and when the second marker is positioned within substantially the same vertical plane as the second sensor.

Other objects, features, and advantages will be apparent to persons of ordinary skill in the art in view of the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following descriptions taken in connection with the accompanying drawings.

DETAILED DESCRIPTION OF PREFERRED EMBODIMENTS

Preferred embodiments of the present invention and their advantages may be understood by referring to FIGS. 1–4, like numerals being used for like corresponding parts in the various drawings.

Figure 1:
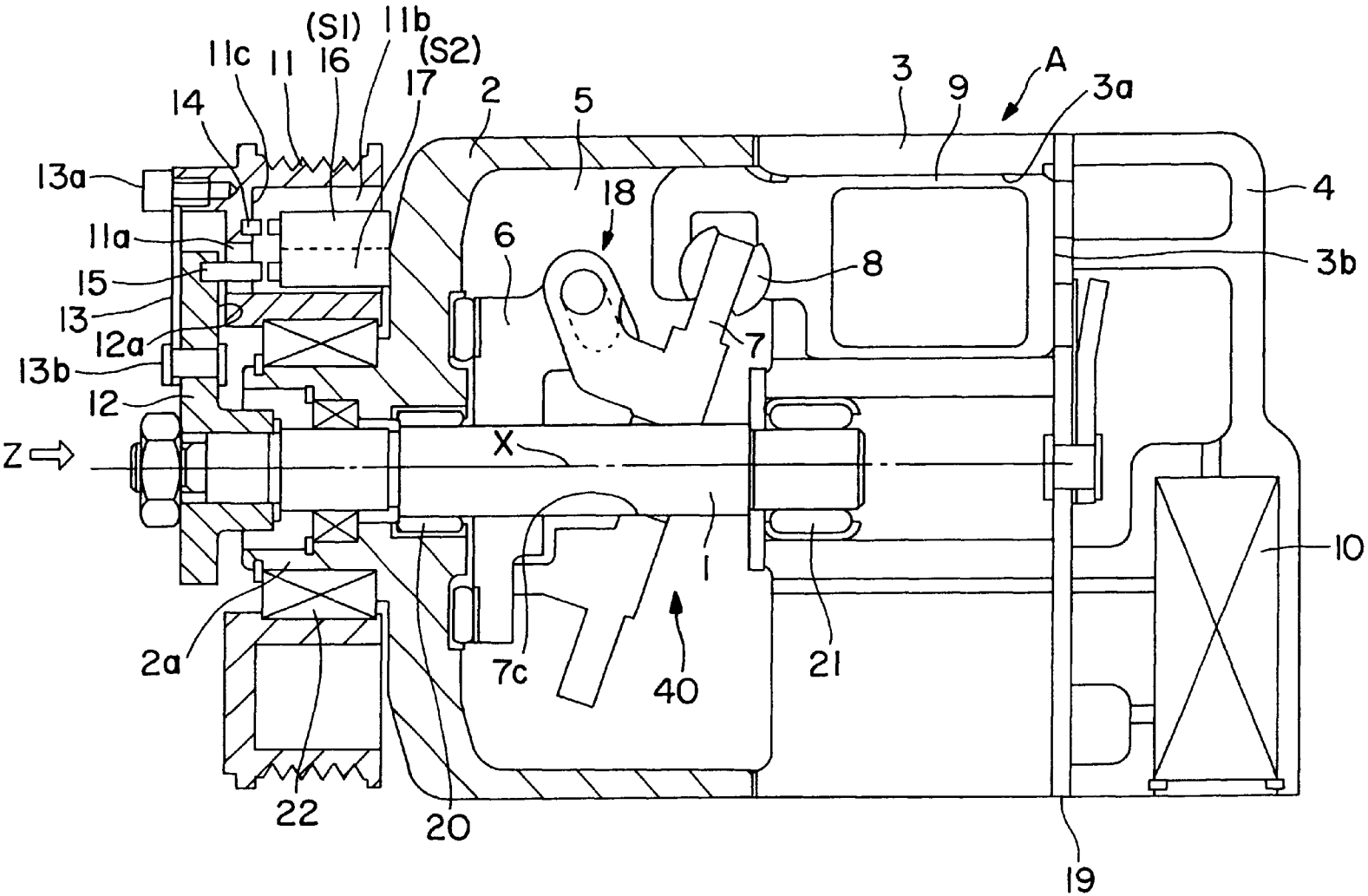
FIG. 1 is a cross-sectional view of a variable-displacement compressor according to a first embodiment of the present invention.

Referring to FIG. 1, a swash plate-type, variable-displacement compressor (A) according to a first embodiment of the present invention is described. Compressor (A) comprises a casing, which comprises a front housing 2, a cylinder block 3, and a cylinder head 4. Compressor (A) also comprises a drive shaft 1, which passes through a substantially center portion of front housing 2 and a substantially center portion of cylinder block 3. Drive shaft 1 is rotatably supported by front housing 2 and by cylinder block 3 via a pair of bearings 20 and 21. Moreover, within cylinder block 3, a plurality of cylinder bores 3*a* may be positioned equal-angularly around an axis X of drive shaft 1. Compressor (A) further may comprise a plurality of pistons 9, each of which may be slidably disposed within one of the cylinder bores 3*a,* and also may reciprocate in a direction parallel to axis X.

Compressor (A) also may comprise a rotor 6 fixed to drive shaft 1, such that rotor 6 may rotate with the drive shaft 1. Moreover, housing 2 and cylinder block 3 define a crank chamber 5. Compressor (A) further may comprise a swash plate 7 positioned within crank chamber 5. Swash plate 7 may have a penetration hole 7*c* formed through a center portion thereof, and drive shaft 1 may be formed through penetration hole 7*c*. Penetration hole 7*c* may have any shape known to those of ordinary skill in the art to enable a change in an inclination angle of swash plate 7 with respect to axis X. Rotor 6 and swash plate 7 may be connected via a hinge mechanism 18, and an upper portion of swash plate 7 may be disk-shaped and also may be slidably connected to a tail portion (not numbered) of piston 9 via a pair of shoes 8. Compressor (A) also may comprise a pulley 11 formed around a cylindrical portion 2*a* of front housing 2. Pulley 11 may be rotatably attached to a bearing 22.

In operation, when an external power source (not shown) drives drive shaft 1, rotor 6 and drive shaft 1 may rotate around axis X, and swash plate 7 may rotate with rotor 6 via hinge mechanism 18. When swash plate 7 rotates, the disk-shaped portion of swash plate 7 may wobble, such that only a movement in a direction parallel to axis X may be transferred to pitons 9 via sliding shoes 8. Consequently, each piston 9 reciprocates within the associated cylinder bore 3*a*. Moreover, when refrigerant from an external refrigeration circuit (not shown) enters a compression chamber 3*b* defined by a top portion of the piston 9, cylinder bore 3*a,* and a valve plate 19, the refrigerant may be compressed by reciprocating piston 9 and discharged to the external refrigeration circuit.

A magnitude of a displacement of compressor (A) may be controlled by a magnitude of a pressure within crank chamber 5, and the pressure within crank chamber 5 may be controlled by a control valve 10 formed within cylinder head 4. The operation of control valve 10 is known to those of ordinary skill in the art and is described in U.S. Pat. No. 5,145,326, the disclosure of which is incorporated herein by reference in its entirety. Therefore, the operation of control valve 10 is not discussed in further detail.

Compressor (A) also may comprise a plate-shaped elastic member 13 and a hub 12. Moreover, a radially outward portion of elastic member 13 may be affixed to pulley 11 via screws 13*a,* and a radially inward portion of elastic member 13 may be affixed to hub 12 via rivets 13*b*. As such, pulley 11 and hub 12 may be concentrically connected via elastic member 13. Hub 12 also may be affixed to drive shaft 1 by employing a key (not shown). Pulley 11 may have an opening or a void 11*b* formed therethrough, and void 11*b* may have a bottom surface 11*c*. Bottom surface 11*c* may have an oblong hole 11*a* formed therethrough. Compressor (A) further may comprise means for determining, e.g., calculating, detecting, measuring, or the like, a torque of compressor (A). The means for determining the torque may comprise a first marker and a second marker, e.g., a first magnet 14 and a second 15, a first optical marking (not shown) and a second optical marking (not shown), or the like. The means for determining the torque also may comprise a first sensor S1 and a second sensor S2, e.g., a first magnetic sensor 16 and a second magnetic sensor 17, a first optical sensor (not shown) and a second optical sensor (not shown), or the like. Magnetic sensors 16 and 17 may be positioned within void 11*b* and may be affixed to front housing 2. Pulley 11 may be connected to first magnet 14 via bottom surface 11*c* of void 11*b*. Moreover, second magnet 15 may be positioned through oblong hole 11*a,* and also may be affixed to a front housing-side surface 12*a* of hub 12. When compressor (A) is in a stopped condition, magnets 14 and 15 may be positioned on a first radial axis, such that magnets 14 and 15 may be positioned on the same radial axis. Similarly, magnetic sensors 16 and 17 may be positioned on a second radial axis, such that magnetic sensors 16 and 17 may be positioned on the same radial axis.

Figure 2:
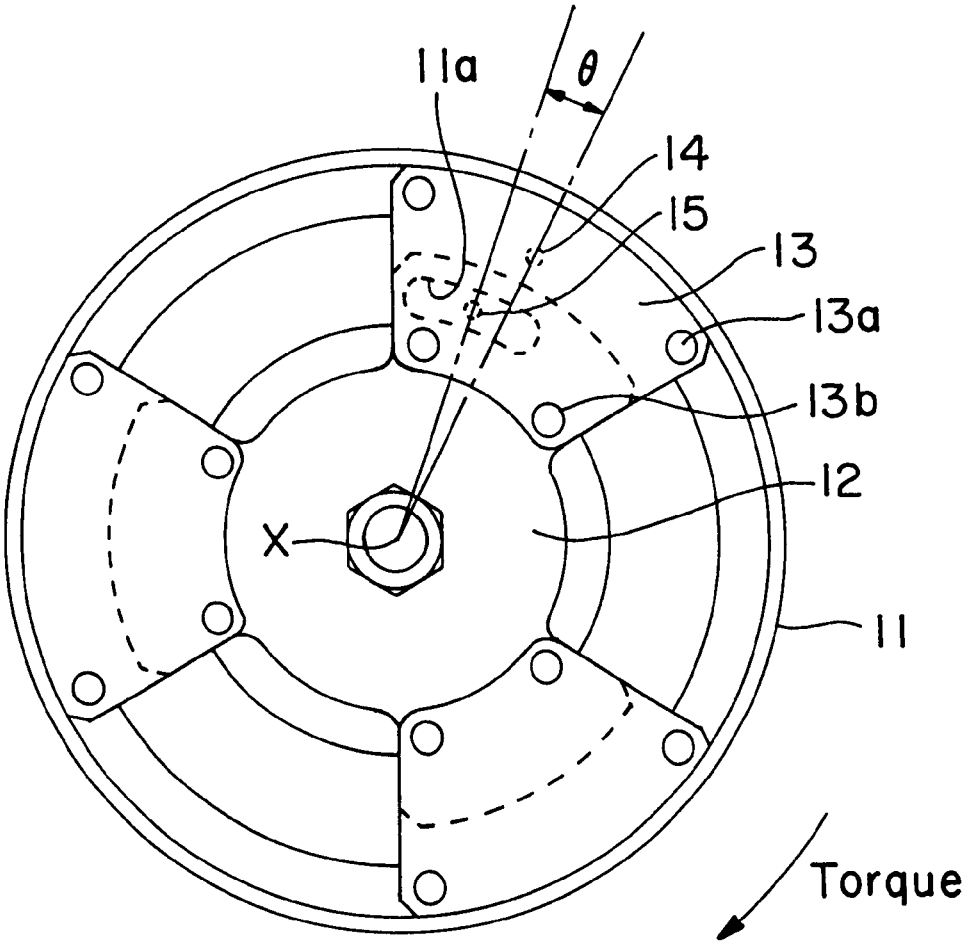
FIG. 2 is a front view of the compressor of FIG. 1 in the direction of arrow Z.

Referring to FIG. 2, when the external power source drives compressor (A), pulley 11 and hub 12 may rotate. When pulley 11 rotates, pulley 11 may exert a rotational force on elastic member 13. Exerting the rotational force on elastic member 13 may cause elastic member 13 to elastically deform in a circular direction. The deformation of elastic member 13 may cause an angular offset θ between magnet 14 and magnet 15. Consequently, there may be a time differential between a signal generated when magnet 14 and sensor 16 are within substantially the same vertical plane, i.e., when a position of magnet 14 relative to a position of sensor 16 is such that sensor 16 receives a signal from magnet 14, and a signal generated when magnet 15 and sensor 17 are within substantially the same vertical plane, i.e., when a position of magnet 15 relative to a position of sensor 17 is such that sensor 17 receives a signal from magnet 15. Moreover, the time differential between the signal generated when magnet 14 is in substantially the same vertical plane as corresponding magnetic sensor 16, and the signal generated when magnet 15 is in substantially the same vertical plane as magnetic sensor 17, may be proportional to a magnitude of compressor torque. As such, when the time differential is known, e.g., detected or measured, the magnitude of torque associated with the time differential may be determined.

In an example, because the magnitude of torque is proportional to the time differential, a formula for mathematically describing the relationship between the time differential and the magnitude of torque may be created. As such, when the time differential is detected or measured during the operation of compressor (A), the magnitude of torque may be determined based on the detected or measured time differential. In another example, a chart listing magnitudes of torque corresponding to various time differentials may be created and stored in a memory. In this example, when the time differential is detected or measured during the operation of compressor (A), the detected or measured time differential may be compared to those time differentials and corresponding compressor torques stored in the memory. As such, the compressor torque may be determined based on the detected or measured time differential.

Figure 3:
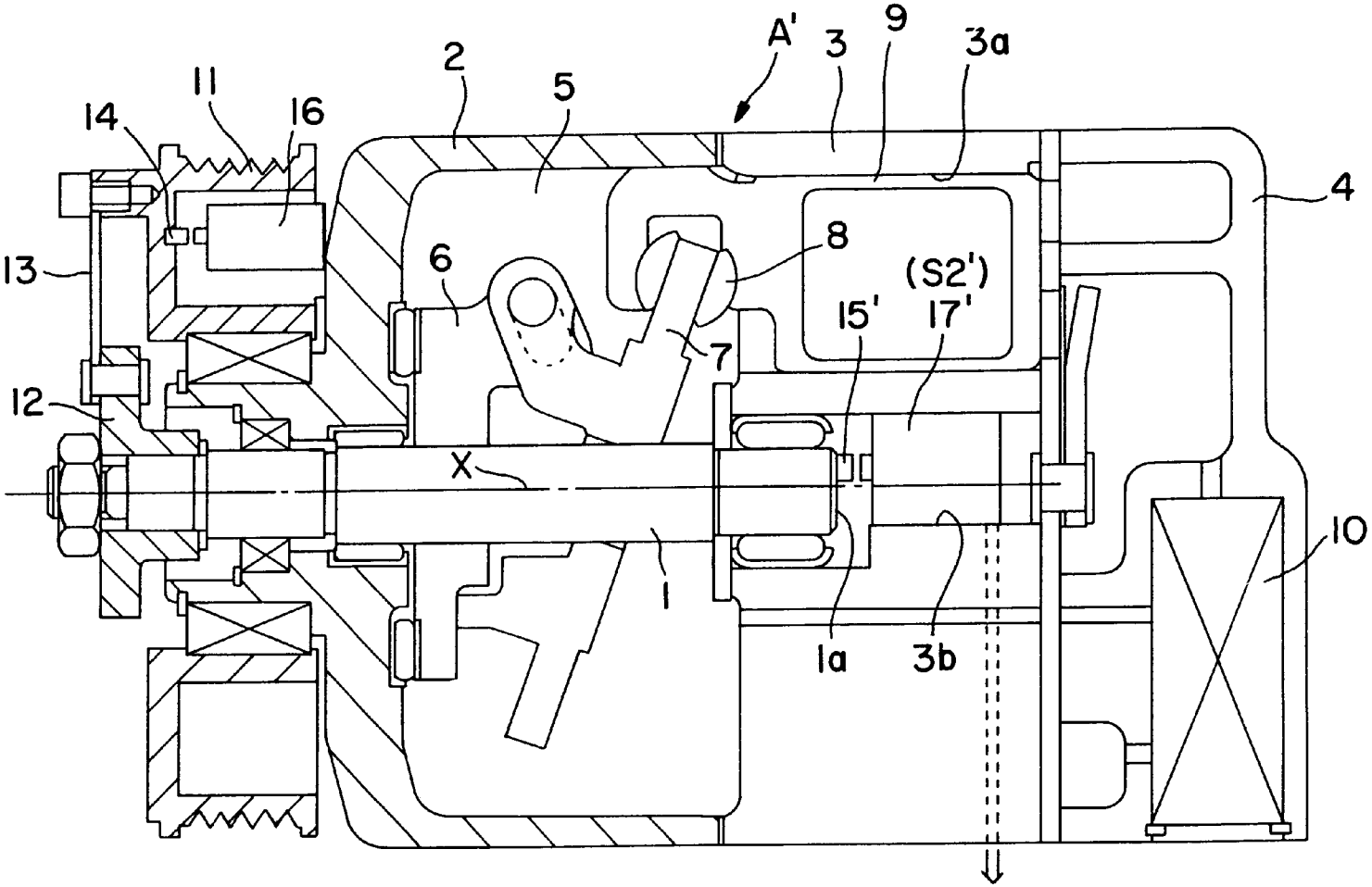
FIG. 3 is a cross-sectional view of a variable-displacement compressor according to a second embodiment of the present invention.

Referring to FIG. 3, a compressor (A') according to a second embodiment of the present invention is described. The features and advantages of the second embodiment are substantially similar to those features and advantages of the first embodiment. Therefore, features and advantages of the first embodiment are not discussed again with respect to the second embodiment. In this embodiment, the means for determining the torque of compressor (A') comprises a first marker and a second marker, e.g., a first magnet 14 and a second magnet 15', a first optical marking (not shown) and a second optical sensor (not shown), or the like. The means for determining the torque also comprises a first sensor S1 and a second sensor S2, e.g., a first magnetic sensor 16 and a second magnetic sensor 17', a first optical sensor (not shown) and a second optical sensor (not shown), or the like. In this embodiment, second magnet 15' may be affixed to an end surface la of drive shaft 1 at a position shifted relative to axis X, and second magnetic sensor 17' may be formed within center bore 3*b* of cylinder block 3.

Figure 4:
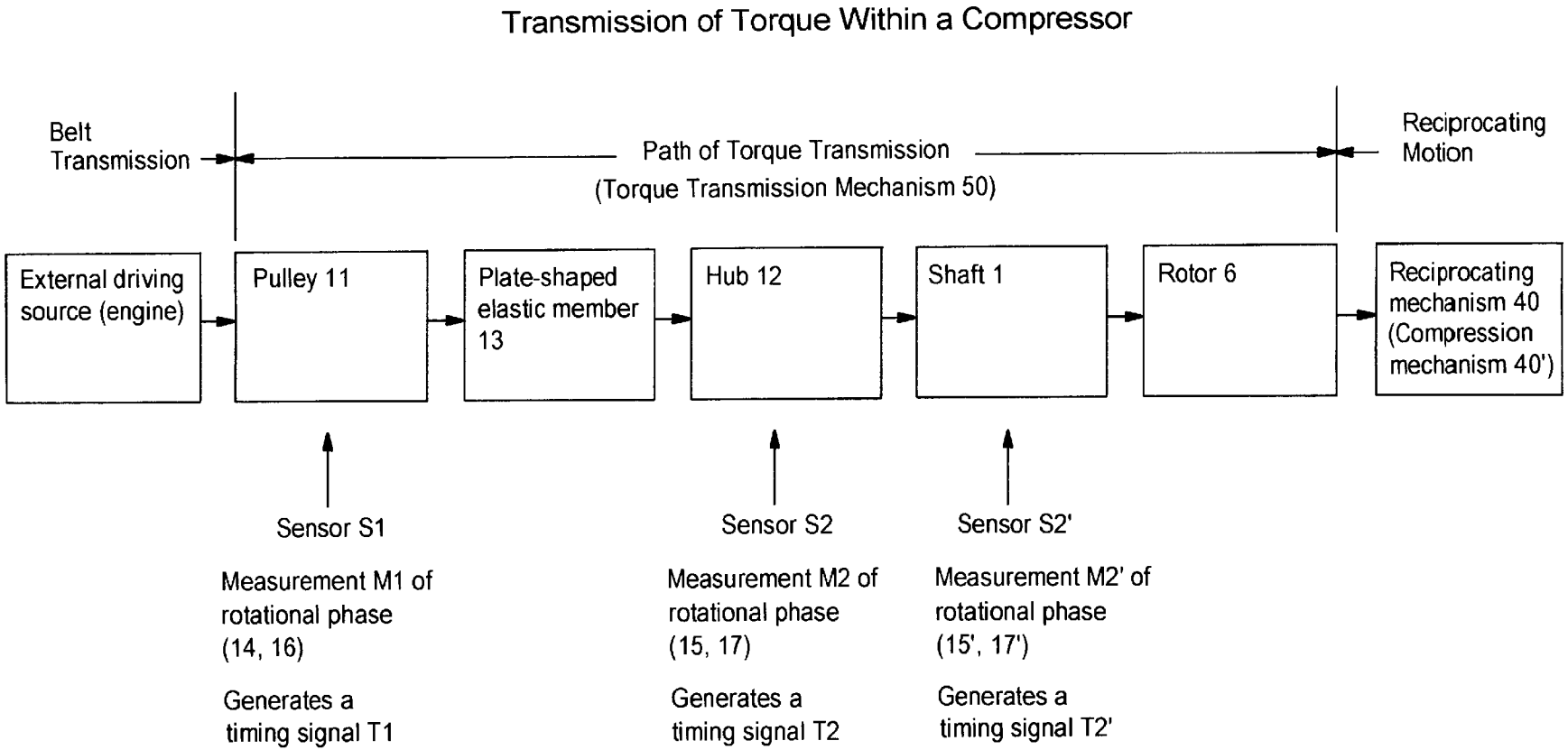
FIG. 4 is a schematic diagram depicting the transmission of torque in a compressor and the positioning of sensors to measure rotational phase and generate timing signals for determining torque.

Referring to FIG. 4, a schematic diagram depicting the transmission of torque in a compressor and the positioning of sensors to measure rotational phase and generate timing signals for determining torque according to any of the foregoing embodiments is described. Compressor (A) and compressor (A') each may comprise a torque transmission mechanism 50 and a compression mechanism, such as a reciprocating mechanism 40. Torque transmission mechanism 50 may comprise pulley 11, elastic member 13, hub 12, drive shaft 1, and rotor 6, and reciprocating mechanism 40 may comprise swash plate 7, shoes 8, and pistons 9. In operation, when pulley 11 rotates via an external driving source (not shown), because pulley 11 is connected to elastic member 13, elastic member 13 is connected to hub 12, hub 12 is connected to drive shaft 1, and shaft 1 is connected to rotor 6, rotor 6 also may rotate. When rotor 6 rotates, swash plate 7 also rotates and the disk-shaped portion of swash plate 7 may wobble, such that a movement in a direction parallel to axis X is transferred to pitons 9 via sliding shoes 8, and each piston 9 reciprocates within the associated cylinder bore 3*a*. Consequently, rotor 6 of torque transmission mechanism 50 may transfer torque to reciprocating mechanism 40 via swash plate 7, and the rotational motion of torque transmission mechanism 50 may result in the reciprocating motion of pistons 9.

Moreover, when pulley 11 rotates, the first marker, e.g., first magnet 14, or the first optical marker (not shown), may rotate in a first concentric orbit. Similarly, when hub 12 or drive shaft 1 rotate, the second marker, e.g., second magnet 15 or 15', or the second optical marker (not shown), may rotate in a second concentric orbit. When the first marker rotates, first sensor S1, e.g., first magnetic sensor 16, or the first optical sensor (not shown), detects the passage of the first marker and generates a first timing signal T1. Similarly, when the second marker rotates, second sensor S2, e.g., second magnetic sensor 17 or 17', or the second optical sensor (not shown), detects the passage of the second marker and generates a second timing signal T2. The relative positions of the first sensor and the second sensor may be selected such that when the torque is zero, there may be no time differential between reception of first timing signal T1 and reception of second timing signal T2. Further, when torque is exerted on torque transmission mechanism 50, a deformation of elastic member 13 may cause an angular offset θ between magnet 14 and magnet 15. Consequently, there may be a time differential between first timing signal T1 and second timing signal T2. Moreover, the time differential between first timing signal T1 and second timing signal T2 may be proportional to a magnitude of compressor torque. As such, when the time differential is known, e.g., when the time differential is detected or is measured during an operation of compressor (A) or compressor (A'), the magnitude of torque may be determined based on the known time differential. Further, it will be understood by those of ordinary skill in the art that the present invention may be used to determine magnitudes of torque in various types of compressors. For example, the present invention may be used to determine magnitudes of torque in wobble plate-type; scroll-type; or vane-type, variable-displacement compressors; or the like.

While the invention has been described in connecting with preferred embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. It is intended that the specification and the described examples are considered as exemplary only, with the true scope and spirit of the invention indicated by the following claims.

What is claimed is:

1. A compressor comprising:

a front housing;

a cylinder block;

a cylinder head;

a torque transmission mechanism, wherein said torque transmission mechanism comprises:

a pulley;

a plate-shaped elastic member connected to said pulley, wherein during a driving of said compressor said plate-shaped elastic member deforms in a circular direction;

a hub connected to said plate-shaped elastic member;

a drive shaft connected to said hub; and a rotor connected to said drive shaft;

a reciprocating mechanism connected to said torque transmission mechanism; and means for determining a torque, wherein said means for determining said torque comprises:

a first marker affixed to said pulley;

a second marker affixed to said hub, wherein said deformation of said plate-shaped elastic member creates an angular offset between said first marker and said second marker;

a first sensor affixed to said front housing, wherein said first sensor generates a first timing signal when said first marker is positioned within substantially the same vertical plane as said first sensor; and a second sensor affixed to said front housing, wherein said second sensor generates a second timing signal when said second marker is positioned within substantially the same vertical plane as said second sensor, wherein there is a time differential between when said first marker is positioned within substantially the same vertical plane as said first sensor and when said second marker is positioned within substantially the same vertical plane as said second sensor, wherein said time differential corresponds to said angular offset and a torque of said compressor is determinable from said time differential.

2. The compressor of claim 1, wherein said compressor is a variable-displacement type compressor.

3. The compressor of claim 1, wherein said first marker comprises a first magnet, said second marker comprises a second magnet, said first sensor comprises a first magnetic sensor, and said second sensor comprises a second magnetic sensor.

4. The compressor of claim 1, wherein said first marker comprises a first optical marking, said second marker comprises a second optical marking, said first sensor comprises a first optical sensor, and said second sensor comprises a second optical sensor.

5. A compressor comprising:

a front housing;

a cylinder block;

a cylinder head;

a torque transmission mechanism, wherein said torque transmission mechanism comprises:

a pulley;

a plate-shaped elastic member connected to said pulley, wherein during a driving of said compressor said plate-shaped elastic member deforms in a circular direction;

a hub connected to said plate-shaped elastic member;

a drive shaft connected to said hub; and a rotor connected to said drive shaft;

a reciprocating mechanism connected to said torque transmission mechanism; and means for determining a torque, wherein said means for determining said torque comprises:

a first marker affixed to said pulley;

a second marker affixed to said drive shaft, wherein said deformation of said plate-shaped elastic member creates an angular offset between said first marker and said second marker;

a first sensor affixed to said front housing, wherein said first sensor generates a first timing signal when said first marker is positioned within substantially the same vertical plane as said first sensor; and a second sensor positioned within a cylinder bore of said cylinder block, wherein said second sensor generates a second timing signal when said second marker is positioned within substantially the same vertical plane as said second sensor, wherein there is a time differential between when said first marker is positioned within substantially the same vertical plane as said first sensor and when said second marker is positioned within substantially the same vertical plane as said second sensor, wherein said time differential corresponds to said angular offset and a torque of said compressor is determinable from said time differential.

6. The compressor of claim 5, wherein said compressor is a variable-displacement type compressor.

7. The compressor of claim 5, wherein said first marker comprises a first magnet, said second marker comprises a second magnet, said first sensor comprises a first magnetic sensor, and said second sensor comprises a second magnetic sensor.

8. The compressor of claim 5, wherein said first marker comprises a first optical marking, said second marker comprises a second optical marking, said first sensor comprises a first optical sensor, and said second sensor comprises a second optical sensor.

9. A compressor comprising:

a casing;

a torque transmission mechanism, wherein said torque transmission mechanism comprises:

a pulley;

a plate-shaped elastic member connected to said pulley, wherein during a driving of said compressor said plate-shaped elastic member deforms in a circular direction; a hub connected to said plate-shaped elastic member;

a drive shaft connected to said hub; and a rotor connected to said drive shaft;

a compression mechanism connected to said torque transmission mechanism;

means for determining a torque, wherein said means for determining said torque comprises:

a first marker affixed to said pulley;

a second marker affixed to said hub or affixed to said drive shaft, wherein said deformation of said plate-shaped elastic member creates an angular offset between said first marker and said second marker;

a first sensor affixed to said front housing, wherein said first sensor generates a first timing signal when said first marker is positioned within substantially the same vertical plane as said first sensor; and a second sensor, wherein when said second marker is affixed to said hub said second sensor is affixed to said front housing and when said second marker is affixed to said shaft said second sensor is positioned within a center bore of said cylinder block, wherein said second sensor generates a second timing signal when said second marker is positioned within substantially the same vertical plane as said second sensor, wherein there is a time differential between when said first marker is positioned within substantially the same vertical plane as said first sensor and when said second marker is positioned within substantially the same vertical plane as said second sensor, wherein said time differential corresponds to said angular offset and a torque of said compressor is determinable from said time differential.

10. The compressor of claim 9, wherein said compressor is a variable-displacement type compressor.

11. The compressor of claim 9, wherein said first marker comprises a first magnet, said second marker comprises a second magnet, said first sensor comprises a first magnetic sensor, and said second sensor comprises a second magnetic sensor.

12. The compressor of claim 9, wherein said first marker comprises a first optical marking, said second marker comprises a second optical marking, said first sensor comprises a first optical sensor, and said second sensor comprises a second optical sensor.

13. The compressor of claim 9, wherein said second marker is affixed to said hub and said second sensor is affixed to said front housing.

14. A method of determining a torque of a compressor comprising the steps of:

affixing a first marker to a pulley;

affixing a second marker to a hub, wherein a circular deformation of a plate-shaped elastic member affixed to said pulley and affixed to a hub creates an angular offset between said first marker and said second marker;

affixing a first sensor to a front housing, affixing a second sensor to said front housing;

generating a first timing signal when said first marker is positioned within substantially the same vertical plane as said first sensor;

generating a second timing signal when said second marker is positioned within substantially the same vertical plane as said second sensor; and determining said torque of said compressor based on a time differential between when said first marker is positioned within substantially the same vertical plane as said first sensor and when said second marker is positioned within substantially the same vertical plane as said second sensor.

15. The compressor of claim 14, wherein said compressor is a variable-displacement type compressor.

16. The compressor of claim 14, wherein said first marker comprises a first magnet, said second marker comprises a second magnet, said first sensor comprises a first magnetic sensor, and said second sensor comprises a second magnetic sensor.

17. The compressor of claim 14, wherein said first marker comprises a first optical marking, said second marker comprises a second optical marking, said first sensor comprises a first optical sensor, and said second sensor comprises a second optical sensor.

18. A method of determining a torque of a compressor comprising the steps of:

affixing a first marker to a pulley;

affixing a second marker to a drive shaft, wherein a circular deformation of a plate-shaped elastic member affixed to said pulley and affixed to a hub creates an angular offset between said first marker and said second marker;

affixing a first sensor to a front housing, affixing a second sensor to a cylinder bore of a cylinder block;

generating a first timing signal when said first marker is positioned within substantially the same vertical plane as said first sensor;

generating a second timing signal when said second marker is positioned within substantially the same vertical plane as said second sensor; and determining said torque of said compressor based on a time differential between when said first marker is positioned within substantially the same vertical plane as said first sensor and when said second marker is positioned within substantially the same vertical plane as said second sensor.

19. The compressor of claim 18, wherein said compressor is a variable-displacement type compressor.

20. The compressor of claim 18, wherein said first marker comprises a first magnet, said second marker comprises a second magnet, said first sensor comprises a first magnetic sensor, and said second sensor comprises a second magnetic sensor.

21. The compressor of claim 18, wherein said first marker comprises a first optical marking, said second marker comprises a second optical marking, said first sensor comprises a first optical sensor, and said second sensor comprises a second optical sensor.

* * * * *